US005423676A

United States Patent [19]

Tsunemi et al.

[11] Patent Number: 5,423,676

[45] Date of Patent: Jun. 13, 1995

[54] WASTE MELTING FURNACE

[75] Inventors: Takeshi Tsunemi; Takashi Fujii, both of Nara; Muneharu Ichikawa, Osaka; Makoto Shimizu, Yokosuka; Tetsuo Horie, Noda; Harunobu Sakabe, Kawasaki, all of Japan

[73] Assignees: Osaka Gas Co., Ltd.; Ishikawajima-Harima Heavy Industries Co., Ltd., both of Japan

[21] Appl. No.: 34,159

[22] Filed: Mar. 22, 1993

[30] Foreign Application Priority Data

Mar. 30, 1992 [JP] Japan ..... 4-071807

[51] Int. Cl.[6] ..... F27D 1/08; E01C 19/45

[52] U.S. Cl. ..... 432/95; 126/343.5 A; 110/238

[58] Field of Search ..... 432/95, 158, 96, 161, 432/97, 99; 110/238; 126/343.5 A

[56] References Cited

U.S. PATENT DOCUMENTS

| | | | |
|---|---|---|---|
| 2,539,638 | 1/1951 | Schilling | 432/96 |
| 3,527,178 | 9/1970 | Southwick . | |
| 3,616,767 | 11/1971 | Southwick . | |
| 3,616,768 | 11/1971 | Southwick . | |
| 3,648,629 | 3/1972 | Southwick . | |
| 3,744,438 | 7/1973 | Southwick . | |
| 3,765,827 | 10/1973 | Beckenbach | 432/95 |
| 4,027,656 | 6/1977 | Geddes et al. | 126/343.5 A |
| 4,351,119 | 9/1982 | Meunier | 432/96 |
| 4,615,285 | 10/1986 | Bentell et al. . | |
| 4,651,656 | 3/1987 | Wallner et al. . | |
| 4,747,773 | 5/1988 | Predescu et al. | 432/99 |
| 4,781,171 | 11/1988 | Hemsath | 126/343.5 A |
| 4,989,522 | 2/1991 | Cline et al. | 110/238 |
| 4,998,486 | 3/1991 | Dighe et al. . | |
| 5,211,555 | 5/1993 | Gardner et al. | 126/343.5 A |

FOREIGN PATENT DOCUMENTS

| | | |
|---|---|---|
| 0143106 | 5/1985 | European Pat. Off. . |
| 0395397 | 10/1990 | European Pat. Off. . |
| 2164733 | 3/1986 | United Kingdom . |

*Primary Examiner*—Henry C. Yuen
*Attorney, Agent, or Firm*—Gifford, Krass, Groh, Sprinkle, Patmore, Anderson & Citkowski

[57] ABSTRACT

A waste melting furnace has a coke layer formed therein, and an annular combustion space formed circumferentially of the coke layer below an upper surface thereof and communicating with the coke layer. A depending wall projects downwardly from an upper position of the combustion space to mark a boundary between the combustion space and the coke layer. A waste is fed in powder form into the combustion space, and burned in the combustion space and the coke layer to be melted and slagged. The depending wall prevents the waste from passing directly into exhaust gas, and causes the waste to remain in the combustion space for a prolonged time before flowing into the coke layer.

4 Claims, 2 Drawing Sheets

FIG. 2 (b) (PRIOR ART)

WASTE MELTING FURNACE

BACKGROUND OF THE INVENTION

1. Field of the Invention

This invention relates to a waste melting furnace proposed to reduce fuel consumption and prevent scattering of dust produced when a waste such as sludge is blown in powder form into a filling layer of a carbon type combustible such as coke to burn the waste and melt the waste into slag. More particularly, the invention relates to a waste melting furnace having a filling layer formed of a carbon type combustible, and an annular combustion space formed around the filling layer below an upper surface thereof and communicating with the filling layer. A waste is supplied in powder form into the combustion space, whereby the waste is burned and slagged in the combustion space and filling layer.

2. Description of the Related Art

When a waste such as sludge is blown in powder form directly into the filling layer in a hot hearth to burn and melt the waste, the waste (sludge) tends to adhere to surfaces of coke to hamper combustion. The temperature of the filling layer also is lowered by an endothermic phenomenon or the like due to the decomposition of organic substances. As a result, the furnace becomes increasingly choked by dust, thereby deteriorating the efficiency of operation.

To eliminate the above drawbacks, a method of burning and melting a waste has been proposed in Japanese Patent Application No. 2-131746, for example. According to this method, as shown in FIG. 2(*b*), a combustion space is formed manually around a filling layer, and combustion gas is fed from the combustion space sideways toward the filling layer.

In this construction, the powdery waste blown in and burned in the combustion space should be melted, charred and slagged in the coke layer to be discharged through an outlet. In practice, however, the waste often becomes scattered as dust into exhaust gas instead of being trapped by the coke layer. Further, in the above burning and melting structure, large quantities of peripheral flows occur in the filling layer so that only regions adjacent peripheral walls become hot. This is considered due to a "peripheral fluidization phenomenon" occurring with an ordinary filling layer structure. That is, in the filling layer structure, the gas blown in through a tuyere tends to flow more smoothly adjacent the peripheral walls than in central regions of the furnace. In a steel making blast furnace, for example, gas velocities in peripheral regions are said to be at least twice gas velocities in central regions. This phenomenon is outstanding where, as in the present invention, a thin filling layer structure is employed.

Thus, the powdery waste blown in is considered to pass through the peripheral walls to scatter in the exhaust gas. Since the gas flows in reduced quantities toward the center of the furnace, the temperature in the furnace center does not become sufficiently high. The furnace inevitably has an uneven temperature distribution therein.

Consequently, the above waste melting furnace tends to suffer the following disadvantages:

(1) Scattering of dust (short-path of the powdery waste), (2) Bridge formation in the filling layer due to the uneven distribution of temperature in the furnace, (3) Increase in coke consumption due to partial combustion of peripheral coke portions and scattering of unburned powdery waste, and (4) Defective output due to an unstable operation of the furnace.

SUMMARY OF THE INVENTION

An object of the present invention is to provide a waste melting furnace capable of suppressing generation of scattering dust, securing a uniform inside temperature, and processing a waste with high efficiency.

The above object is fulfilled, according to the present invention, by a waste melting furnace comprising a filling layer formed of a carbon type combustible, and an annular combustion space formed circumferentially of the filling layer below an upper surface thereof and communicating with the filling layer, whereby a waste is fed in powder form into the combustion space, and burned in the combustion space and the filling layer to be; melted and slagged, the furnace further comprising depending wall projecting downwardly from an upper position of the combustion space to mark a boundary between the combustion space and the filling layer.

A combustion gas may be directed obliquely downward to flow from the combustion space into the filling layer.

The present invention has the following functions and effects.

By providing the depending wall or controlling directions of combustion gas flows, the powdery waste blown into the combustion space is directed downward to flow into the filling layer. Combustion of the waste is promoted in central regions of the filling layer, and the filling layer has a uniformed temperature distribution transversely thereof. The waste is burned in an increased quantity (with a reduction in the quantity of scattering dust), thereby increasing the treating temperature. Consequently, the waste is prevented from making short paths, as in the prior art, to flow from the combustion space upward adjacent lateral walls of the filling layer.

On the other hand, the combustion gas in the annular combustion space is fed into the filling layer while circulating in the combustion space around the filling layer. The depending wall or the flow control corresponding thereto assures a sufficient residence time in the combustion space. As a result, treatment of the waste in the combustion space is enhanced.

Thus, the waste melting furnace according to the present invention achieves a temperature increase based on combustion of the waste and complete combustion of combustibles. The furnace may be maintained at a predetermined temperature with ease, and is operable steadily.

With the waste melting furnace according to the present invention, short paths of the waste are prevented to diminish the quantity of scattering waste dust. Further, the combustion is promoted in the combustion space to increase the temperature, thereby uniforming the temperature of the filling layer in the furnace and stabilizing operation of the furnace.

The above factors effectively prevent partial melting of the waste in high-temperature regions and bridge formation due to dust adhesion in low-temperature regions. Besides, a reduction is made in the consumption of a carbon type combustible (such as coke) forming the filling layer to treat the waste.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

A waste melting furnace according to the present invention will be described in detail hereinafter with reference to the drawings.

Figure 1:
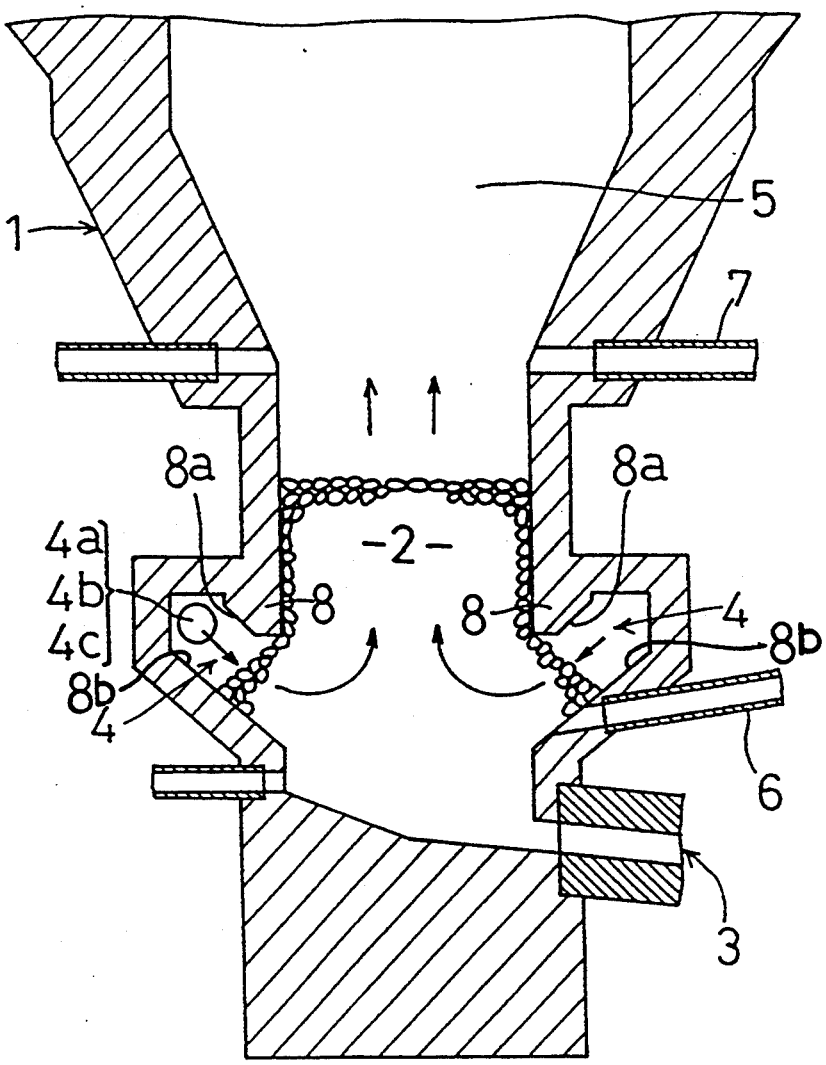
FIG. 1 is a view showing a construction of a waste melting furnace.

FIG. 1 shows a section of a waste melting furnace 1 adjacent a filling layer of coke 2. The waste melting furnace 1 has the filling layer of coke 2 which approximately is in the form of a vertical cylinder. The furnace 1 defines an outlet 3 in a lower position of the coke layer 2 for outputting molten slag. An annular combustion space 4 is formed circumferentially of the coke layer 2 below an upper surface thereof. A freeboard 5 is formed above the coke layer 2. The furnace 1 further includes a primary air supply nozzle 6 for supplying primary air to the coke layer 2, and a secondary air supply nozzle 7 disposed adjacent an inlet of the freeboard 5 for supplying secondary air.

The combustion space 4 includes a waste supply nozzle 4*a* for supplying sludge in powder form as entrained by carrier air, a combustion oxygen supply nozzle 4*b* for blowing in a gas containing combustion oxygen, and an auxiliary fuel supply nozzle 4*c* for blowing in an auxiliary fuel. In the combustion space 4, the fuel is burned, and the powdery sludge fed into the combustion space 4 is dried and burned. Combustion gases are fed along with unburned substances into the coke layer 2 while describing a locus around the coke layer 2.

The furnace 1 has a depending wall 8 formed of a refractory material and projecting downwardly from an upper position of the combustion space 4 to mark a boundary between the combustion space 4 and coke layer 2. The wall 8 has a descending guide surface 8*a* opposed to the combustion space 4 and inclined away from the coke layer 2 as it extends upward. A bottom guide surface 8*b* extends generally parallel with the descending guide surface 8*a*. The depending wall 8 causes a delay in the combustion gases flowing into the coke layer 2 (i.e. an increase in circulating quantity), compared with a construction having no such depending wall. In addition, the combustion gases flow obliquely downward into the coke layer 2.

Operation of the waste melting furnace 1 according to the present invention will be described next. The coke layer 2 is burned with preheated primary air blown in through the primary air supply nozzle 6 in a lower position of the coke layer 2 to act as the oxygen-containing gas. The coke layer 2 maintains a high temperature of 1500° to 1600° C. The waste such as sludge in dried powder form having about 10% water content is blown into the combustion space 4 through the waste supply nozzle 4*a*. The waste is burned and melted, and fed into the coke layer 2. Unburned substances are also melted and slagged in the coke layer 2. The molten product is discharged through the outlet 3. To effect the burning and melting process smoothly, it is necessary to maintain the temperature in the combustion space 4 at least at 1200° C., and to maintain the temperature in the coke layer 2 at least at 1400° to 1500° C. In the waste melting furnace 1 according to the present invention, the depending wall 8 causes the powdery waste and oxygen-containing gas blown into the combustion space 4 to flow downwardly into the coke layer 2, thereby preventing short-paths along the peripheral walls. Consequently, this waste melting furnace 1 secures the operating conditions in which the waste remains in the combustion space 4 for a sufficient period of time to achieve complete combustion of combustible substances and temperature increases due to the combustion. The furnace may be maintained at a predetermined temperature to be operable steadily.

Where, as in the prior art, the depending wall 8 is not provided, powdery dust is not sufficiently burned in the combustion space. The waste such as sludge is scattered in dust form into the exhaust gas.

Experimental data on utility of the present invention will be described next with reference to FIGS. 2(*a*) and (*b*).

Figure 2:
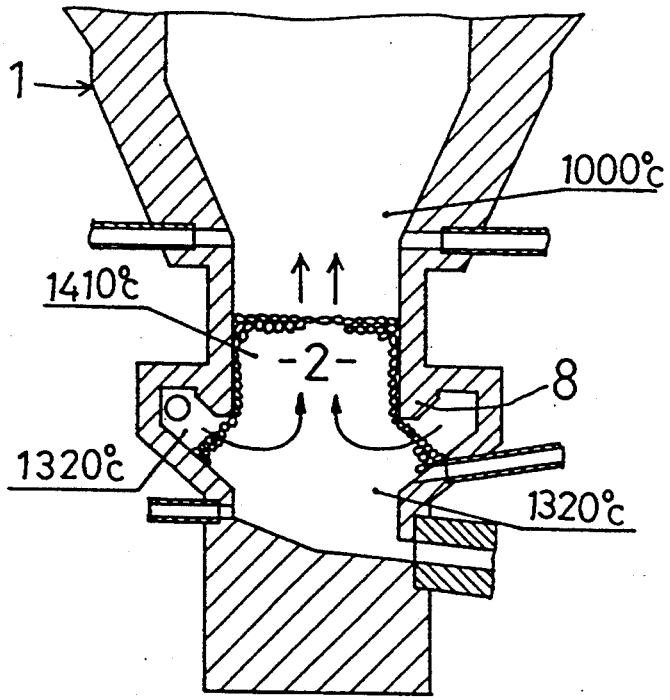
FIGS. 2(*a*) and (*b*) are views showing results of comparison of temperatures in a furnace built according to the present invention and a furnace according to the prior art.
Figure 2:
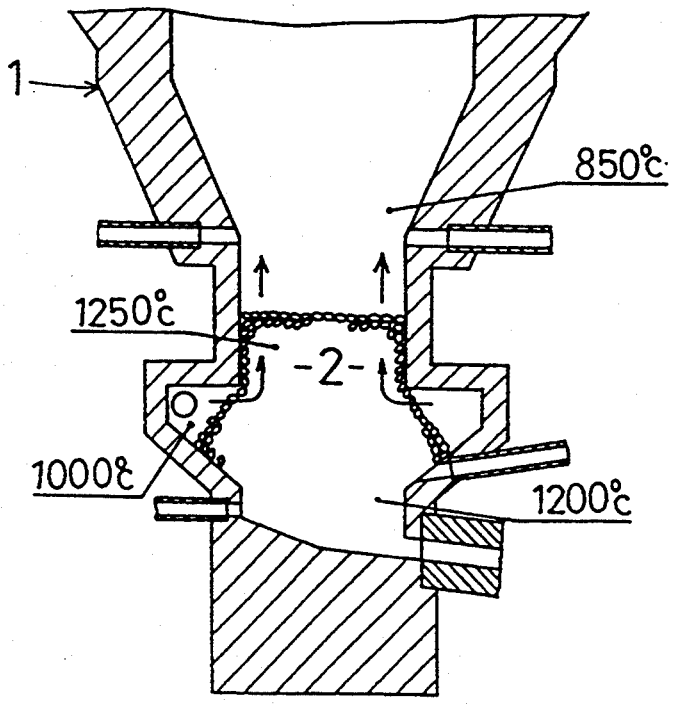

FIG. 2(*a*) schematically shows a temperature distribution inside the waste melting furnace 1 having the depending wall 8. FIG. 2(*b*) shows a conventional waste melting furnace having no depending wall.

The following table shows test results on operating conditions of the respective waste melting furnaces.

| | [Test Results] with depend wall | without depend wall |
|---|---|---|
| sludge (kg/h) | 30 | 30 |
| coke (kg/h) | 12 | 20 |
| scattering dust ($g/Nm^3$) | 2.2 | 6 |
| primary air ($Nm^3/h$) | 62 | 70 |
| air into combustion space ($Nm^3/h$) | 60 | 90 |

As seen from the above results, the furnace having the depending wall 8 achieves an increased and uniform temperature, while reducing the amount of coke required to treat the same quantity of sludge. The quantity of scattering dust is also substantially diminished.

The waste melting furnace according to the present invention has the construction and function described above. On the other hand, it has been proposed to change the coke layer structure for controlling the flows in the furnace. According to this proposal, the coke layer 2 is formed thick in the peripheral regions and thin in the central regions to prevent the dust of the powdery waste from passing along the peripheral walls to feed the largest possible quantity of waste into the coke layer 2. However, this measure cannot be employed since the coke layer 2 is formed thin in the present invention. It is also conceivable to increase the rate at which the powdery waste is blown into the combustion space, in order to deliver the waste toward the central regions in the furnace. This measure, again, is not available since the coke layer will be fluidized for the same reason.

The present invention provides the depending wall 8 between the combustion space 4 and coke layer 2 to prevent the air and powdery waste blown into the combustion space 4 from making short paths along the walls directly into the freeboard 5. This construction produces the outstanding effect noted above.

Other embodiments will be described next.

In the above embodiment, the depending wall has a triangular vertical section extending downwardly. Instead of this configuration, the depending wall may have a square vertical section extending downwardly. That is, the depending wall may have any suitable shape to prevent the gas introduced from the combustion space 4 into the coke layer 2 from moving directly to lateral regions of the coke layer 2 and passing through the coke layer 2 without being burned.

The depending wall 8, instead of being a solid structure formed of a refractory material as in the foregoing embodiment, may have a hollow structure to provide a water cooling or boiler structure.

While coke is used in the foregoing embodiment, the fuel may be any other carbon type combustible.

What is claimed is:

1. A waste melting furnace for melting waste material in a powder form, said furnace comprising:

a cylindrical, vertically extending shaft;

a filling layer in said shaft formed of a carbon type reducing combustible;

an annular combustion space surrounding said shaft, wherein said combustion space is in open circumferentially contiguous communication with said filling layer below an upper surface thereof;

a depending cylindrical wall projecting downwardly from an upper position of said combustion space to mark a boundary between said combustion space and said filling layer; and introduction means having a descending guide surface and a bottom guide surface extending generally parallel with said guide surface for introducing said powder form waste material obliquely downwardly into said combustion space and directing combination gasses downwardly into said filling layer;

whereby said powdered waste material is burned in said combustion space and is directed around said depending cylindrical wall travelling upward in said filling layer to be further burned, melted and slagged.

2. A waste melting furnace as defined in claim 1, further comprising an outlet formed in a lower position of said shaft in communication with said filling layer for outputting molten slag, a primary air supply nozzle for supplying primary air to said shaft and into said filling layer, and a secondary air supply nozzle disposed for supplying secondary air in a freeboard in said shaft above and adjacent the upper surface of said filling layer.

3. A waste melting furnace as defined in claim 1, wherein said introduction means includes a waste supply nozzle for supplying said waste in form of powdery sludge as entrained by carrier air, and further including a combustion oxygen supply nozzle for blowing a gas containing combustion oxygen into said combustion space, and an auxiliary fuel supply nozzle for blowing an auxiliary fuel into said combustion space.

4. A waste melting furnace as defined in claim 1, wherein said depending cylindrical wall is formed of a refractory material and wherein said descending guide surface projects downwardly from said upper position of said combustion space to mark the boundary between said combustion space and said filling layer, said guide surface being opposed to said combustion space and inclined away from said filling layer as said guide surface extends upward.

* * * * *

UNITED STATES PATENT AND TRADEMARK OFFICE

CERTIFICATE OF CORRECTION

PATENT NO. : 5,423,676

DATED : June 13, 1995

INVENTOR(S) : Takeshi Tsunemi et al.

It is certified that error appears in the above-indentified patent and that said Letters Patent is hereby corrected as shown below:

Column 2, line 23, after "be" delete ";".
Column 2, line 24, after "comprising" insert --a--.
Column 6, line 3, "gasses" should be --gases--.
Column 6, line 7, "travelling" should be -traveling--

Signed and Sealed this

Ninth Day of January, 1996

Bruce Lehman

*Attest:*

BRUCE LEHMAN

*Attesting Officer*

*Commissioner of Patents and Trademarks*